US007983578B2

(12) United States Patent
Yoshida et al.

(10) Patent No.: US 7,983,578 B2
(45) Date of Patent: Jul. 19, 2011

(54) IMAGE FORMING DEVICE WITH A MANUAL DARKNESS ADJUSTING SECTION

(75) Inventors: Toru Yoshida, Ebina (JP); Shigeru Tsukada, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 11/266,470

(22) Filed: Nov. 4, 2005

(65) Prior Publication Data

US 2007/0172245 A1 Jul. 26, 2007

(30) Foreign Application Priority Data

Nov. 9, 2004 (JP) ..... 2004-325125
Oct. 4, 2005 (JP) ..... 2005-291524

(51) Int. Cl.
*G03G 15/00* (2006.01)

(52) U.S. Cl. ..... 399/38; 399/49

(58) Field of Classification Search ..... 399/38, 399/49

See application file for complete search history.

(56) References Cited

U.S. PATENT DOCUMENTS 5,606,395 A * 2/1997 Yang et al. ..... 399/81

FOREIGN PATENT DOCUMENTS

| | | |
|---|---|---|
| JP | 2002-218243 | 8/2002 |
| JP | 2002-218244 | 8/2002 |
| JP | 2003-289439 | 10/2003 |
| JP | 2004-266544 | 9/2004 |

* cited by examiner

*Primary Examiner* — David M Gray
*Assistant Examiner* — Erika Villaluna
(74) *Attorney, Agent, or Firm* — Morgan, Lewis & Bockius LLP

(57) ABSTRACT

An image forming device includes an image forming section; a storage section that stores a target darkness of a standard image; a measurement section that measures the darkness of the image formed by the image forming section; a user calibration section that causes the image forming section to form a standard image causes the measurement section to measure the darkness of that standard image, and if there is a discrepancy between the darkness of the standard image specified by the measurement of the physical quantity and the target darkness stored in the storage section, adjusts the image formation conditions to eliminate the discrepancy; a manual darkness adjustment section that changes the image formation conditions to content that is specified by the user; a control section that causes the image forming section to follow image formation conditions that do not reflect the content changed by the manual darkness adjustment section.

8 Claims, 6 Drawing Sheets

IMAGE FORMING DEVICE WITH A MANUAL DARKNESS ADJUSTING SECTION

BACKGROUND

1. Technical Field

The present invention relates to technology for adjusting image formation conditions of an image forming device.

2. Related Art

In image forming devices such as copiers or printers, recording methods such as electrophotography, thermal printing, inkjet printing or the like are used. Image forming devices have been subjected to various improvements in accordance with the characteristics of these recording methods, in order to fulfill such user demands as high-speed, and high-quality image formation.

For example, image forming devices employing electrophotography utilize the electrostatic effect of toner, which is made of microscopic particles, and therefore the image quality tends to drop due to fluctuations in the image darkness that occur when the toner is affected by environmental or temporal changes in temperature or humidity, or due to tiny variations in the structural components of the image forming device. Accordingly, electrophotographic image forming devices are commonly provided with a function for adjusting image darkness, in order to sustain a stable image quality.

Image darkness adjustment means the forming of a standard image, such as a pattern image or patch image or the like, on a recording material (paper or the like) or image-carrying member (photosensitive member, intermediate transfer belt or the like), based on a target darkness that has been stored beforehand, and if the darkness of the formed standard image does not match the target darkness, adjusting the conditions relating to the image formation (hereinafter referred to as "image formation conditions"), such as the exposure potential during exposure or the amount of toner that is discharged during development or the like, such that the darkness of the formed standard image becomes the target darkness. By performing such an image darkness adjustment, images having a constant quality can be formed over a long period of time.

Generally, there are two kinds of image darkness adjustment, namely "automatic darkness adjustment" in which the image forming device itself performs the image darkness adjustment automatically when the power is turned on, when the apparatus is idle, or at predetermined time intervals; and "user calibration" in which the user instructs the image forming device to perform an image darkness adjustment, for example, when the user feels that the image quality has dropped. In these two kinds of image darkness adjustment, the specific methods for adjusting the image darkness may be the same, or they may be different.

Further, in addition to these two kinds of image darkness adjustment, image forming devices are normally also provided with a function by which the user can operate an operation section or the like of the image forming device to change the image formation conditions (hereinafter referred to as "manual darkness adjustment"). This manual darkness adjustment is often performed when the formed image does not have a level of image darkness or a color hue that is desired by the user. That is to say, the above-described automatic darkness adjustment and user calibration are adjustments for attaining a standard image quality, whereas the manual darkness adjustment is enables a user to select an image quality.

The automatic darkness adjustment and the user calibration are both adjustments for attaining a standard image quality. Therefore, after either an automatic darkness adjustment or a user calibration has been carried out, the image formation conditions should be the same, and if an identical image is output, then the image quality should be the same.

However, if the method for adjusting the image darkness differs between the automatic darkness adjustment and the user calibration, then the image formation conditions do not necessarily match after the respective image darkness adjustments have been carried out, so there is a risk that the output results will be different. A technology has been developed with an object of addressing this problem by generating correction data from print output characteristic information, that corresponds respectively to a "device calibration", which is equivalent to the automatic darkness adjustment, and a "software calibration", which is equivalent to the user calibration.

However, in these conventional technologies, the result of carrying out both the automatic darkness adjustment and the manual darkness adjustment, or both the user calibration and the manual darkness adjustment, is not taken into consideration.

As an example, a case will be explained where the image formation conditions are adjusted to a user's liking; that is, the image formation conditions after a manual darkness adjustment has been carried out are "lighter" than the image formation conditions after an automatic darkness adjustment has been carried out, that is, the standard image formation conditions. When the manual darkness adjustment is carried out, and a first automatic darkness adjustment is started in a state in which the image formation conditions are "lighter" than the standard image formation conditions, then the image forming device will form a standard image that is "lighter" than standard. Thus, a correction is performed to form a "darker" image, for example a correction is performed by which the look-up table is overwritten in a manner resulting in a larger output for a given input signal (see FIG. 12). After this automatic darkness adjustment, the image formation conditions approach the standard conditions, but in this situation, the user's preferences are not reflected, and the user again has to perform a manual darkness adjustment in order to set image formation conditions that are "lighter" than the standard image formation conditions. Thus, when the automatic darkness adjustment is performed for a second time, a correction is performed such that an image is formed which is even "darker" than the previous image. When such an adjustment is carried out repeatedly, the manual darkness adjustment and the automatic darkness adjustment will make repeated corrections in opposite directions. As a result, the second correction will be larger than the first and the third will be larger than the second, and the correction amount will continue to increase.

Furthermore, when a large correction is performed as described above, the image forming device is not able to form an image using the original number of gradations, resulting in a problem that, for example, tone jumps brought about by the reduction of the number of gradations occur, and the reproducibility of the original image is compromised.

SUMMARY

In one embodiment of the present invention, an image forming device is provided that includes an image forming section that forms an image in accordance with predetermined conditions; a storage section that stores a target darkness of a standard image; a measurement section that measures a physical quantity for specifying the darkness of an image formed by the image forming section; a user calibration section that causes the image forming section to form a standard image in response to an instruction input by a user, causes the measurement section to measure the physical quantity when the standard image is formed, and if there is a discrepancy between the darkness of the standard image specified by measurement of the physical quantity and the target darkness stored in the storage section, adjusts the image formation conditions to eliminate this discrepancy; a manual darkness adjustment section that changes the image formation conditions to content specified by the user; and a control section that, when the user calibration section causes the image forming section to form the standard image, causes the image forming section to follow image formation conditions that do not reflect the content changed by the manual darkness adjustment section.

In another embodiment of the present invention, an image forming device is provided that includes an image forming section that forms an image in accordance with predetermined conditions; a storage section that stores a target darkness of a standard image; a measurement section that measures a physical quantity for specifying the darkness of an image formed by the image forming section; a user calibration section that causes the image forming section to form a standard image in response to an instruction input by a user, causes the measurement section to measure the physical quantity when the standard image is formed, and if there is a discrepancy between the darkness of the standard image specified by the measurement of the physical quantity and the target darkness stored in the storage section, adjusts the image formation conditions to eliminate this discrepancy; a manual darkness adjustment section that changes the image formation conditions to content specified by the user; and a control section that reflects the content of the image formation conditions changed by the manual darkness adjustment section in the target darkness that is stored in the storage section.

In yet another embodiment of the present invention, an image forming device is provided that includes an image forming section that forms an image in accordance with predetermined conditions; a storage section that stores a target darkness of a standard image; a measurement section that measures a physical quantity for specifying the darkness of an image formed by the image forming section; an automatic darkness adjustment section that, at a predetermined timing, causes the image forming section to form a standard image based on the target darkness stored in the storage section, causes the measurement section to measure the physical quantity when the standard image is formed, and if there is a discrepancy between the darkness of the standard image specified by the measurement of the physical quantity and the target darkness stored in the storage section, adjusts the image formation conditions to eliminate this discrepancy; a manual darkness adjustment section that changes the image formation conditions to content specified by a user; and a control section that, when the automatic darkness adjustment section causes the image forming section to form the standard image, causes the image forming section to follow image formation conditions that do not reflect the content changed by the manual darkness adjustment section.

In a further embodiment of the present invention, an image forming device is provided that includes an image forming section that forms an image in accordance with predetermined conditions; a storage section that stores a target darkness of a standard image; a measurement section that measures a physical quantity for specifying the darkness of an image formed by the image forming section; an automatic darkness adjustment section that, at a predetermined timing, causes the image forming section to form a standard image based on the target darkness stored in the storage section, causes the measurement section to measure the physical quantity when the standard image is formed, and if there is a discrepancy between the darkness of the standard image specified by the measurement of the physical quantity and the target darkness stored in the storage section, adjusts the image formation conditions to eliminate this discrepancy; a manual darkness adjustment section that changes the image formation conditions to content that is specified by the user; and a control section that reflects the content of the image formation conditions changed by the manual darkness adjustment section in the target darkness that is stored in the storage section.

BRIEF DESCRIPTION OF THE DRAWINGS

Embodiments of the present invention will be described in detail based on the following figures, wherein.

DETAILED DESCRIPTION

(1) Configuration

Figure 1:
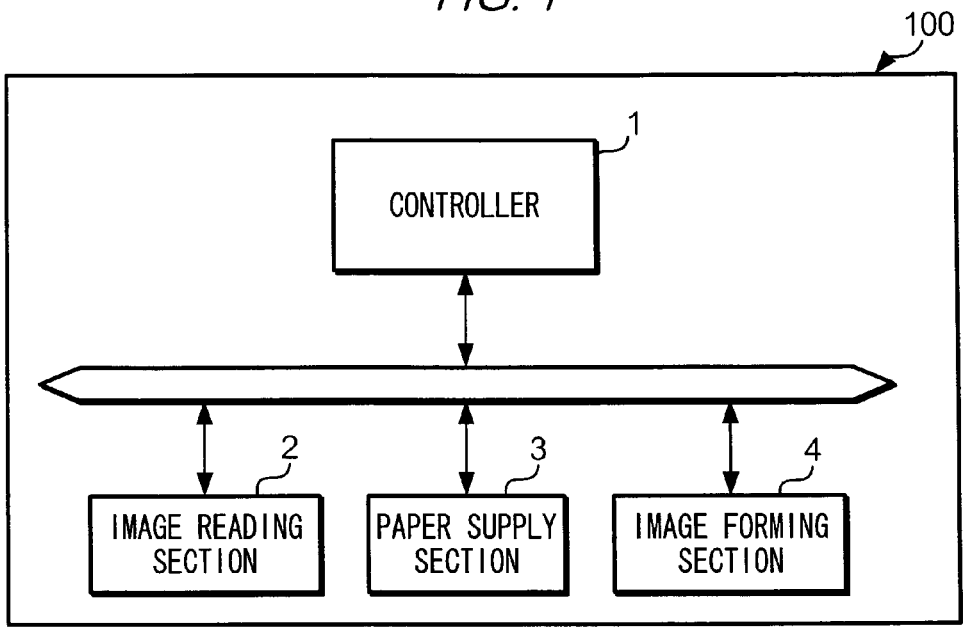
FIG. 1 is a block diagram showing the overall configuration of an image forming device according to an embodiment of the present invention.

FIG. 1 is a block diagram showing the overall configuration of an image forming device 100 according to an embodiment of the present invention. The image forming device 100 is an electrophotographic image forming device, commonly referred to as a multifunction machine, which, in broad terms, includes an image reading section 2, a paper supply section 3 and an image forming section 4. The operation of each of these sections is controlled by a controller 1.

Figure 2:
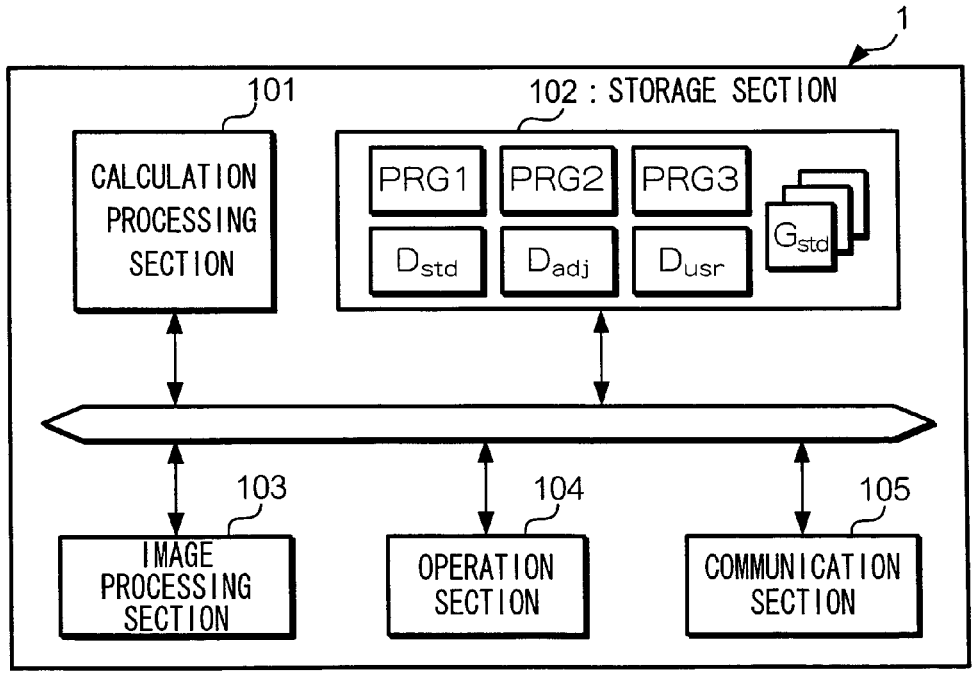
FIG. 2 is a block diagram showing the configuration of the controller in this embodiment.

FIG. 2 is a block diagram showing the configuration of the controller 1. As shown in this figure, the controller 1 includes a calculation processing section 101, a storage section 102, an image processing section 103, an operation section 104, and a communication section 105.

The calculation processing section 101 includes a calculation device, such as a CPU (Central Processing Section), and main storage devices, such as a ROM (Read Only Memory) and a RAM (Random Access Memory), and carries out calculation processes related to the operation of each of the sections of the image forming device 100. For example, by executing an automatic darkness adjustment program PRG1, a user calibration program PRG2 and a manual darkness adjustment program PRG3, the calculation processing section 101 realizes automatic darkness adjustment, user calibration, and manual darkness adjustment, which are described below.

The storage section 102 is an auxiliary storage device, such as an HDD (Hard Disk Drive), and stores programs, such as the above-noted automatic darkness adjustment program PRG1, user calibration program PRG2 and manual darkness adjustment program PRG3, and further stores, for each necessary color, multiple sets of standard image data $G_{std}$ for forming standard pattern image (to be described later), a standard static electricity patch and a standard toner patch (also hereinafter referred to collectively as "standard image"). The contents of the standard image data $G_{std}$ serve as the target values of the darkness in the standard image. Further, the storage section 102 provides a storage region for storing standard darkness data $D_{std}$, adjustment darkness data $D_{adj}$, and user-defined darkness data $D_{usr}$ that are used for the calculation of a look-up table (to be described later). If no automatic darkness adjustment or user calibration and manual darkness adjustment are carried out, then the storage region of the adjustment darkness data $D_{adj}$ and the user-defined darkness data $D_{usr}$ stores no data; that is, the entire storage region is filled with "0"s.

The image processing section 103 is provided with multiple LSI (Large Scale Integration) circuits, and performs various kinds of image processing. In addition to, for example, image rotation, size conversion (magnification and shrinking) and image forming mode conversion that is performed by user instruction, this image processing includes a gradation correction of the formed image gradation through application of the look-up table to the image data. There is an LSI circuit for each of these types of image processing, and the image data are supplied to the LSI corresponding to the type of image processing, in the image processing section 103.

The operation section 104 is, for example, a touch panel-type liquid crystal display, which displays information to a user via various screen images, and accepts instructions input by the user.

The communication section 105 is an interface for connecting to a network or to an external device, such as a computer. The image forming device 100 may receive image data supplied via this communication section 105.

Figure 3:
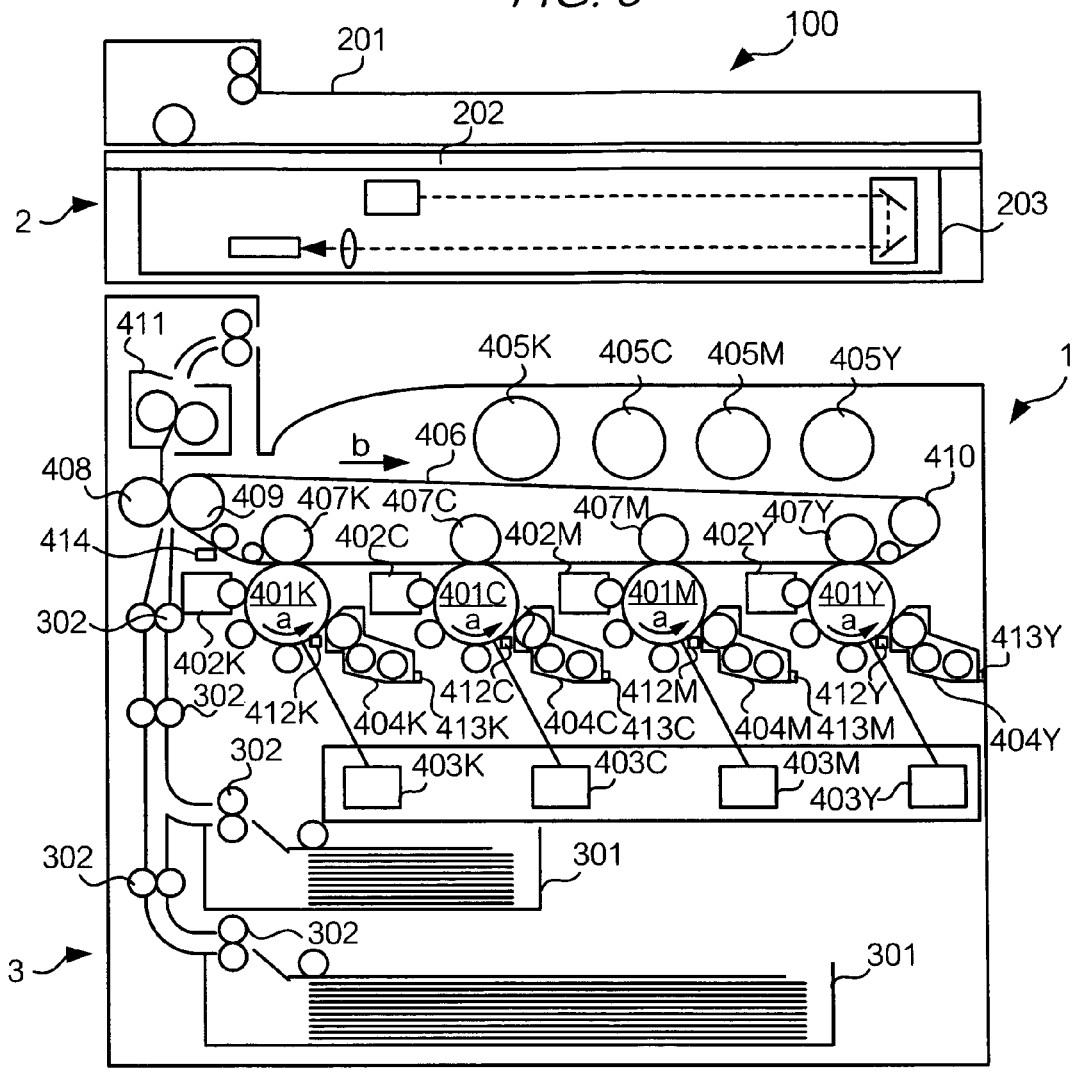
FIG. 3 is a diagram illustrating the configuration of the image reading section, the paper supply section and the image forming section of the image forming device of this embodiment.

Referring to FIG. 3, the following is an explanation of the configuration of the image reading section 2, the paper supply section 3 and the image forming section 4 of the image forming device 100.

The image reading section 2 is a so-called scanner, and includes an automatic document feeder 201, a platen glass 202, and a scan unit 203. Paper that is placed on the automatic document feeder 201 is fed to the platen glass 202 and is read by the scan unit 203. The scan unit 203 is provided with a lamp, mirrors, an imaging lens and a line sensor, which are not shown in the drawings. The scan unit 203 optically reads the image on the paper and generates image data in accordance with this image.

The paper supply section 3 includes multiple paper trays 301 containing paper of various sizes, and multiple paper feed rolls 302 for feeding paper, and supplies paper corresponding to the size of the image to be formed to the image forming section 4.

The image forming section 4 includes photosensitive members 401Y, 401M, 401C and 401K of the colors yellow (Y), magenta (M), cyan (C) and black (K) that rotate in the direction of the arrows "a" shown in the drawing, charge devices 402Y, 402M, 402C and 402K for uniformly charging these photosensitive members 401Y, 401M, 401C and 401K, exposure devices 403Y, 403M, 403C and 403K for forming electrostatic latent images of the colors YMCK by irradiating exposure light that is modulated based on the image data of the colors YMCK onto the charged photosensitive members 401Y, 401M, 401C and 401K, developing devices 404Y, 404M, 404C and 404K forming toner images on the photosensitive members 401Y, 401M, 401C and 401K with toner by developing the electrostatic latent images formed on the photosensitive members 401Y, 401M, 401C and 401K, and toner supply devices 405Y, 405M, 405C and 405K supplying toner of various colors to the developing devices 404Y, 404M, 404C and 404K.

The image forming section 4 includes an intermediate transfer belt 406 spanning a backup roll 409 and a drive roll 410 and circulating in the direction of arrow "b" shown in the figure, while contacting the photosensitive members 401Y, 401M, 401C and 401K, and the primary transfer rolls 407Y, 407M, 407C and 407K that respectively form nip regions with the photosensitive members 401Y, 401M, 401C and 401K, to thereby sandwich the intermediate transfer belt 406, and a toner image is thereby transferred from the circumferential surface of the photosensitive members 401Y, 401M, 401C and 401K to the intermediate transfer belt 406 in the nip regions, a secondary transfer roll 408 that forms a nip region with the backup roll 409, to sandwich the intermediate transfer belt 406, and to thereby transfer the toner image on the intermediate transfer belt 406 in a secondary transfer process onto the paper, and a fixing device 411 fixing the toner image that has been transferred onto the paper during the secondary transfer process by heating the toner and applying pressure.

Furthermore, the image forming section 4 of the present embodiment is provided with multiple sensors for performing an automatic darkness adjustment and a user calibration.

Potential sensors 412Y, 412M, 412C and 412K respectively measure the surface potential of the electrostatic latent image formed on the photosensitive members 401Y, 401M, 401C and 401K. Toner darkness sensors 413Y, 413M, 413C and 413K respectively measure the toner concentration (that is, the mixing ratio of toner and carrier) inside the developing devices 404Y, 404M, 404C and 404K. A toner image darkness sensor 414 measures the darkness of the toner image that has been transferred onto the intermediate transfer belt 406 (toner image darkness). For these sensors, any suitable sensor known in the art can be used.

Figure 4:
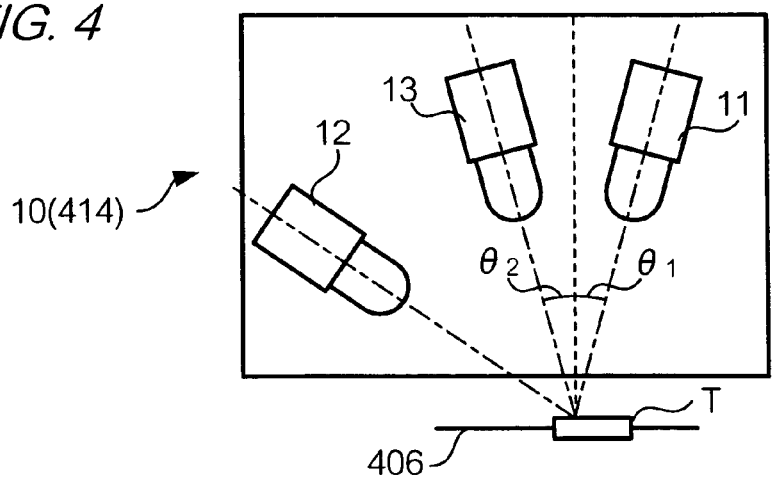
FIG. 4 shows an ADC sensor, which is an example of the toner image darkness sensor of this embodiment.

FIG. 4 shows an ADC sensor 10, which is an example of the toner image darkness sensor 414. The ADC sensor 10 includes an LED (Light Emitting diode) 11 for black, an LED 12 for color, and a light-receiving sensor 13. The ADC sensor 10 measures the light reflected from the toner image T on the intermediate transfer belt 406, and supplies a voltage value corresponding to the measured amount of light to the controller 1. Since the optical reflectance characteristics differ for black (K) toner images and for color (C, M, Y) toner images, the light reflected from those toner images is measured by different sensors.

To measure the darkness of a color toner image, light is irradiated by the LED 12 for color, while the LED 11 for black stays turned off. Then, the light-receiving sensor 13 receives the diffuse reflection light from the color toner image T. On the other hand, to measure the darkness of a black toner image, light is irradiated by the LED 11 for black, while the LED 12 for color stays turned off. Then, the light-receiving sensor 13 receives the specular reflection light from the black toner image T. Thus, the light-receiving sensor 13 is arranged at the position where it can receive the most of the specular reflection component of the light reflected by the black toner image T when light is irradiated from the black LED 11, that is, at a position where the ingoing angle $\theta_1$ and the reflection angle $\theta_2$ are substantially the same with respect to the normal irradiation position of the LED 11 for black. The light reflected from the color toner image is diffuse reflection light, so that the higher the toner image darkness is, the larger the output voltage becomes. On the other hand, the light reflected from the black toner image is specular reflection light, so that the higher the toner image darkness is, the smaller the output voltage becomes. This is because the higher the toner image darkness is, the higher the proportion of the intermediate transfer belt 406 covered by the toner image becomes, and as a result, the specular reflection light of the surface of the intermediate transfer belt 406 is reduced.

(2) Operation

With the above-described configuration, the image forming device 100 of the present embodiment forms a toner image with the image forming section 4 and, based on image data supplied remotely, or based on image data generated with the image reading section 2, forms an image on paper by fixing the toner image on paper supplied from the paper supply section 3, and ejects the paper. At this time, the controller 1 of the image forming device 100 causes the image to be formed in accordance with standard image formation conditions determined by the image forming section 4. However, if the color hue of the image formed with the standard image formation conditions does not match the user's preferences, then the user can adjust the image darkness of the YMCK colors via the operation section 104.

Figure 5:
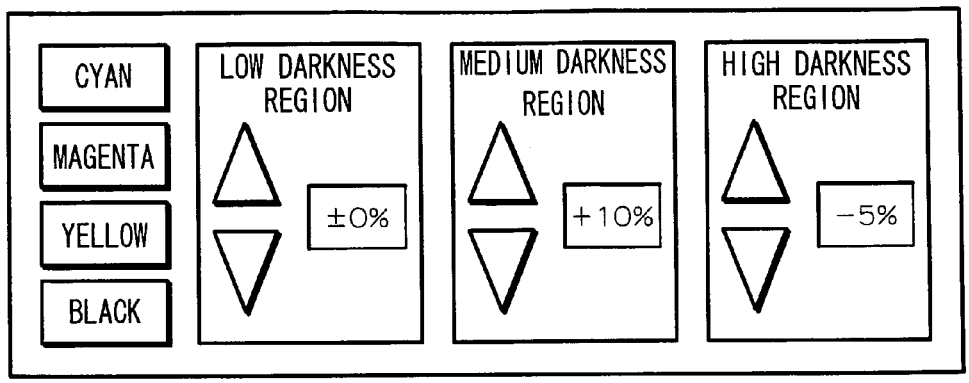
FIG. 5 shows an example of an image displayed on the operation section in this embodiment.

FIG. 5 shows an example of an image displayed on the operation section 104 in this situation. It can be seen that, in the present embodiment, for each of the YMCK colors, the image darkness of the low darkness regions, intermediate darkness regions and high darkness regions can be specified for example with "denser" and "lighter" to ratios of 0 to 100%.

Moreover, when repeated image formations are performed continuously, variations in the image darkness of the image forming device 100, and thus a drop in image quality, may occur. To avoid this, the image formation apparatus 100 carries out an automatic darkness adjustment at predetermined times, and moreover, a user calibration is carried out in response to user instruction, and the image formation conditions are adjusted.

There are multiple parameters for adjusting the image formation conditions. In the present embodiment, such parameters are the charge potential of the charge devices 402Y, 402M, 402C and 402K, the exposure amount of the exposure devices 403Y, 403M, 403C and 403K, the developing bias potential of the developing devices 404Y, 404M, 404C and 404K, the toner supply amounts of the toner supply devices 405Y, 405M, 405C and 405K, and the look-up tables applied to the image data by the image processing section 103. When the image formation conditions are adjusted, at least one of these parameters is manipulated. The parameters that are manipulated during the automatic darkness adjustment and the parameters that are manipulated during the user calibration may be the same or different.

The following is an explanation of specific operating methods of the image forming device 100. Here, an example is explained, in which the look-up tables are manipulated in order to adjust the image formation conditions.

Figure 6:
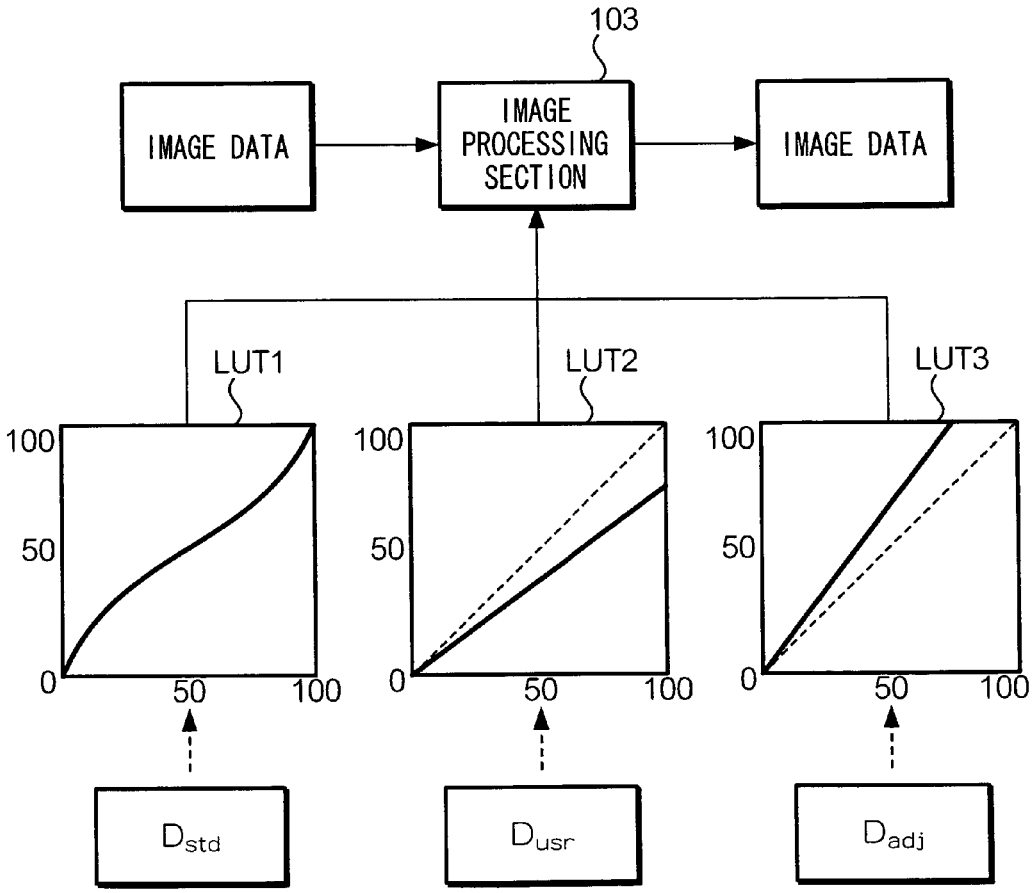
FIG. 6 shows an outline of the process of applying look-up tables to the image data with the image processing portion of this embodiment.

FIG. 6 shows an outline of the process of applying look-up tables to the image data with the image processing portion 103. The look-up tables LUT1 to LUT3 of FIG. 6 indicate the input/output ratio of each pixel of the image data. Their horizontal axis denotes the input values and the vertical axis denotes the output values.

The look-up table LUT1 is created based on the standard darkness data $D_{std}$ stored in the storage section 102, and is the look-up table that is applied in the initial state of the image forming device 100, that is, in the state in which no image darkness adjustment (automatic darkness adjustment, user calibration) or manual darkness adjustment has been performed.

The look-up table LUT2 is generated based on user-defined darkness data $D_{usr}$ stored in the storage section 102. The user-defined darkness data $D_{usr}$ store the content of manual darkness adjustments input by the user. By performing a calculation in which the look-up table LUT1 and the look-up table LUT2 are applied in superposition by the image processing section 103, an image is formed that reflects the content of the manual darkness adjustment performed by the user.

The look-up table LUT3 is generated based on adjustment darkness data $D_{adj}$ stored in the storage section 102. The adjustment darkness data $D_{adj}$ store the execution result of the automatic darkness adjustment or the user calibration. By a calculation in which the look-up table LUT1 and the look-up table LUT3 are applied in superposition by the image processing section 103, an image is formed that reflects the adjustment content due to the automatic darkness adjustment or the user calibration.

Moreover, for example, if the user performs a manual darkness adjustment after an automatic darkness adjustment has been performed, then the image processing section 103 performs a calculation in which the look-up tables LUT1, LUT2 and LUT3 are superposed with each other.

The following is an explanation of the processing procedure for automatic darkness adjustment and user calibration in accordance with the present embodiment. In accordance with the present invention, several methods can be conceived for these procedures. Accordingly, four types of operation examples are described in the following, with an explanation of the respective procedures.

It should be noted that in the following example, it is assumed that the image forming device 100 is in a condition in which a manual darkness adjustment has been performed by the user. This means that immediately before carrying out the automatic darkness adjustment or user calibration, the image forming device 100 forms an image reflecting the content of the manual darkness adjustment. That is to say, in this situation, the image processing section 103 of the image forming device 100 performs a calculation in which it applies the look-up table LUT1 and the look-up table LUT2 in superposition to the entered (regular) image data, and after this calculation the image data are supplied to the image forming section 4.

(2-1) Operation Example 1

Figure 7:
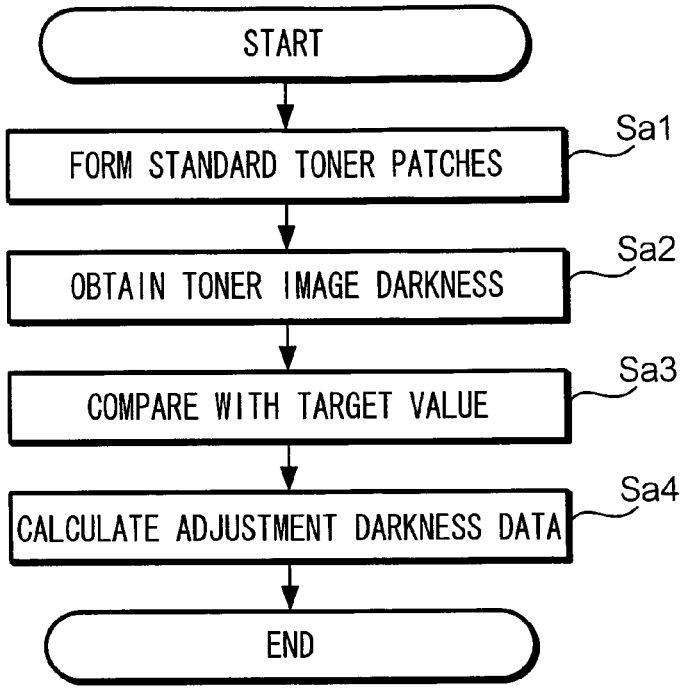
FIG. 7 is a flowchart showing an example of a first operation of the automatic darkness adjustment according to the present embodiment.

FIG. 7 is a flowchart showing a first operation example of the automatic darkness adjustment according to the present embodiment. Explaining this first operation example in the order shown in the figure, first the controller 1 of the image forming device 100 causes the image forming section 4 to form a standard toner patch in each of the CMYK colors (Step Sa1). A standard toner patch is a toner image measuring, for example, 1 cm on each of its four sides, the image being formed on the intermediate transfer belt 406 based on the standard image data $G_{std}$ stored in the storage section 102 of the controller 1. In this situation, when the calculation processing section 101 of the controller 1 recognizes that the formed toner image is a standard toner patch, it causes the image processing section 103 to execute a calculation in which only the look-up table LUT1 but not the look-up table LUT2 is applied to the standard image data $G_{std}$. That is to say, in this situation, the controller 1 forms a standard toner patch without reflecting the content that has changed due to the manual darkness adjustment instructed by the user. Thus, one of the features of this operation example is the aspect that the controller 1 performs image processing of the standard image data $G_{std}$ using a procedure that is different from that for the ordinary image data.

After the standard toner patches have been formed, the controller 1 causes the toner image darkness sensor 414 to measure the toner image darkness of the standard toner patches on the intermediate transfer belt 406, and obtains the toner image darkness of the standard toner patch of each color (Step Sa2). Then, the controller 1 compares the obtained toner image darkness of the standard toner patch of each color with the standard image data $G_{std}$ serving as the target value (Step Sa3), calculates adjustment darkness data $D_{adj}$ corresponding to the respective differences and stores the adjustment darkness data $D_{adj}$ in the storage section 102 (Step Sa4).

As is explained above, the adjustment darkness data $D_{adj}$ are the data expressing the look-up table LUT3. The adjustment darkness data $D_{adj}$ are generated based on the difference between the toner image darkness of the standard toner patch and the standard image data $G_{std}$ serving as the target value. For example, if the toner image darkness of a standard toner patch representing a certain darkness region is "lighter" than the target value, then the adjustment darkness data $D_{adj}$ of this darkness region are values correcting this darkness region to be "darker". Similarly, if the toner image darkness of a standard toner patch representing a certain darkness region is "darker" than the target value, then the adjustment darkness data $D_{adj}$ of this darkness region are values correcting this darkness region to be "lighter". The adjustment darkness data $D_{adj}$ are data in which such correction values are given for each darkness region.

After the above process is finished, the controller 1 applies a look-up table reflecting the result of both the manual darkness adjustment and the automatic darkness adjustment to the image data that are entered thereafter. That is to say, the controller 1 causes the image processing section 103 to perform a calculation on the image data by applying the look-up tables LUT1, LUT2 and LUT3 in superposition. The image formation conditions are adjusted through this calculation, and if there is a discrepancy between the image darkness of each color and the target darkness, then the image darkness of the respective darkness region is changed to a value at which this discrepancy is reduced. Thus, the fluctuations in the image darkness of the image forming device 100 are corrected.

Furthermore, as described above, the image forming device 100 performs image processing of the standard image data $G_{std}$ that is different than that of the ordinary image data, and forms standard toner patches without reflecting the content that has changed due to the manual darkness adjustment instructed by the user.

(2-2) Operation Example 2

The following is an explanation of an automatic darkness adjustment with a procedure that is different to from that of the above-described Operation Example 1.

Figure 8:
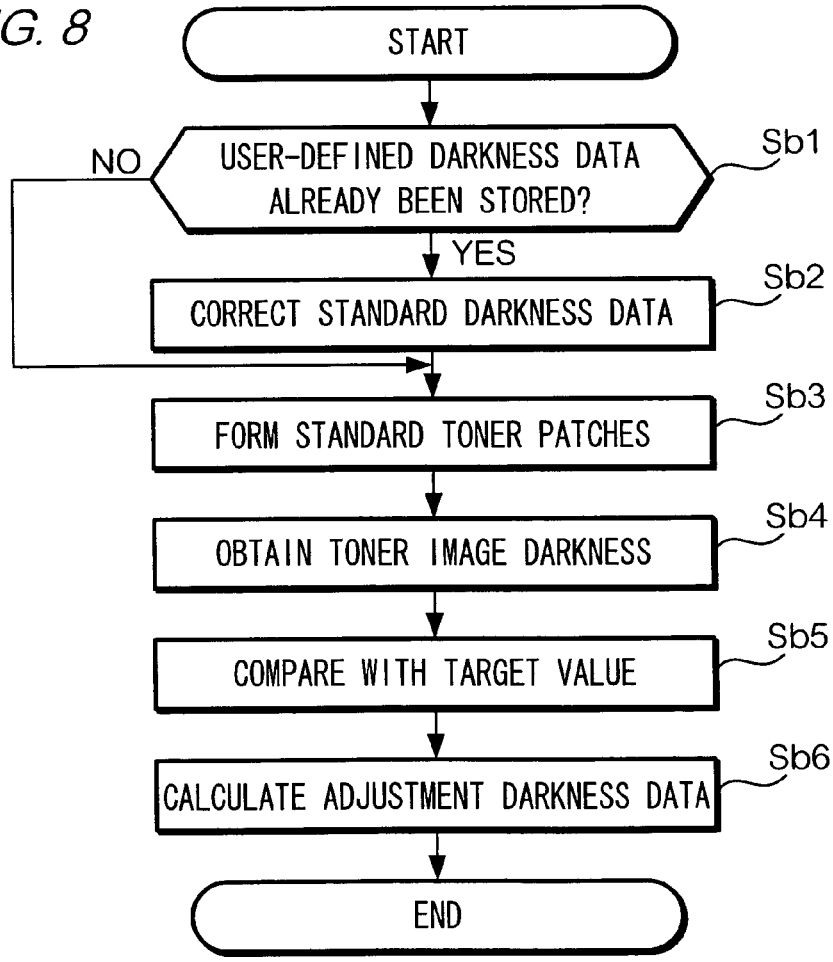
FIG. 8 is a flowchart showing an example of a second operation of the automatic darkness adjustment according to the present embodiment.

FIG. 8 is a flowchart showing a second operation example of the automatic darkness adjustment according to the present embodiment. Explaining this second operation example in the order shown in the figure, first the controller 1 of the image forming device 100 judges whether a manual darkness adjustment has been carried out prior to this automatic darkness adjustment, by looking up the storage region of the storage section 102 in which the user-defined darkness data $D_{usr}$ are stored (Step Sb1). Then, if it recognizes that user-defined darkness data $D_{usr}$ are stored (Step Sb1: YES), the controller 1 judges that a manual darkness adjustment has been carried out prior to this automatic darkness adjustment, corrects the standard darkness data $D_{std}$ stored in the storage section 102 in accordance with the value of the user-defined darkness data $D_{usr}$, and performs processing that causes the target value of the standard image to reflect the content that has changed due to the manual darkness adjustment by the user (Step Sb2). The degree to which the target value of the standard image is caused to reflect the content that has changed due to the manual darkness adjustment by the user can be set as required.

If no user-defined darkness data $D_{usr}$ are stored (Step Sb1: NO), then the controller 1 judges that no manual darkness adjustment has been carried out prior to the execution of the automatic darkness adjustment, and the above-described processing of Step Sb2 is skipped.

After these processes are finished, the controller 1 causes the image forming section 4 to form standard toner patches of each of the CMYK colors (Step Sb3). In this situation, the calculation processing section 101 of the controller 1 subjects the standard image data $G_{std}$, like the ordinary image data, to a calculation in which the look-up table LUT1 and the look-up table LUT2 are applied in superposition.

After the standard toner patches have been formed, the controller 1 causes the toner image darkness sensor 414 to measure the toner image darkness of the standard toner patches on the intermediate transfer belt 406, and obtains the toner image darkness of the standard toner patch of each color (Step Sb4). Then, the controller 1 compares the obtained toner image darkness of the standard toner patch of each color with the standard image data $G_{std}$ serving as the target value (Step Sb5), calculates adjustment darkness data $D_{adj}$ corresponding to the respective differences, and stores the adjustment darkness data $D_{adj}$ in the storage section 102 (Step Sb6).

After the above process is finished, the controller 1 applies a look-up table reflecting the result of both the manual darkness adjustment and the automatic darkness adjustment to any image data entered thereafter. That is to say, fluctuations of the image darkness in the image forming device 100 are corrected by the same procedure as in the above-described Operation Example 1.

Figure 9A:
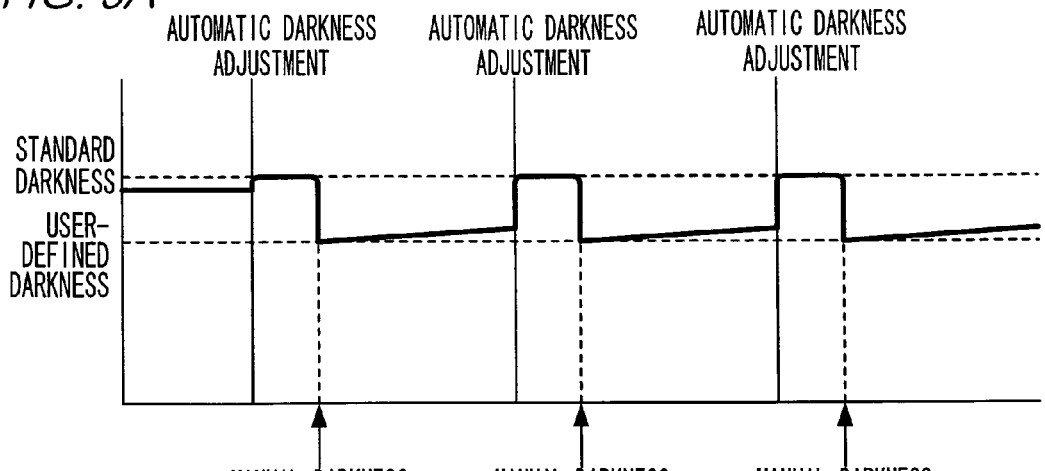
FIG. 9 illustrates the result of the example of an operation in FIG. 8.
Figure 9B:
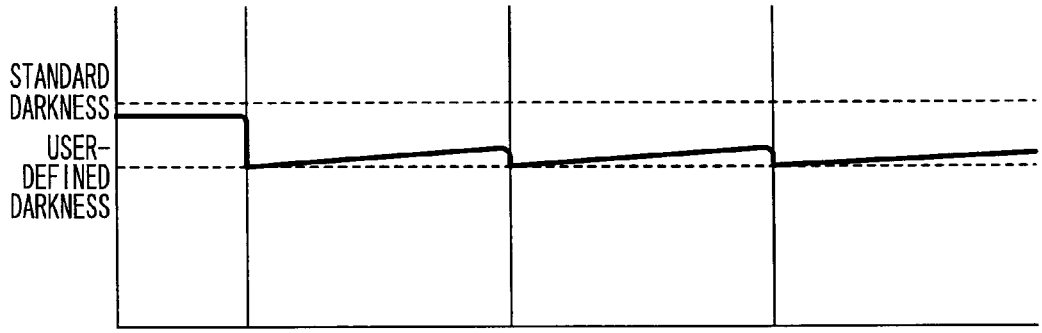

FIG. 9 illustrates the result of these operation examples. FIG. 9(A) shows the case that an automatic darkness adjustment is periodically carried out without performing a correction of the standard image data $G_{std}$, and FIG. 9(B) shows the case that an automatic darkness adjustment is periodically carried out while the standard image data $G_{std}$ is corrected in accordance with the user-defined darkness data $D_{usr}$, as in the present operation example. Moreover, "standard darkness" means the image darkness in the event that a standard image is formed under the standard image formation conditions of the initial state, and "user-defined darkness" means the image darkness in the event that a standard image is formed under image formation conditions input by the user.

In the case of FIG. 9(B), that is, in the case of the present operation example, when an automatic darkness adjustment is carried out, then, differently than the case of FIG. 9(A), the image darkness is adjusted so that it matches the user-defined darkness, or is adjusted so that the image darkness at least approaches the user-defined darkness (that is, the difference is in the extent in which the content that has changed due to the manual darkness adjustment by the user is reflected in the target value of the standard image).

(2-3) Operation Example 3

The following is an explanation of the procedure for user calibration according to the present embodiment.

Figure 10:
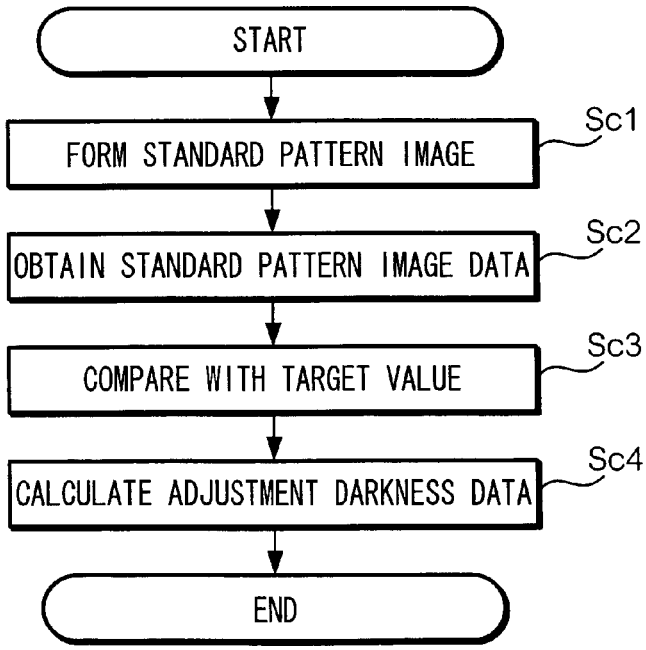
FIG. 10 is a flowchart illustrating an example of a first operation of user calibration according to this embodiment.

FIG. 10 is a flowchart illustrating a first operation example of user calibration according to this embodiment. Explaining this operation example in the order shown in the figure, first, the controller 1 of the image forming device 100 causes the image forming section 4 to form a standard pattern image, and outputs this standard pattern image (Step Sc1). A standard pattern image is an image that is formed on paper based on the standard image data $G_{std}$ stored in the storage section 102 of the controller 1, and in which 1 $cm^2$ patch images of different color and darkness are formed repeatedly and continuously.

After the standard pattern image has been output, the user sets it into the automatic document feeder 201 of the image reading section 2, and causes the standard pattern image on the paper to be read in. Thus, image data resulting from the reading in of the standard pattern image are generated by the image reading section 2 of the image forming device 100 (Step Sc2). In the following, these image data are referred to as "standard pattern image data". Then, the controller 1 compares the standard pattern image data with the standard image data $G_{std}$ serving as the target values (Step Sc3), calculates adjustment darkness data $D_{adj}$ corresponding to the respective differences and stores the adjustment darkness data $D_{adj}$ in the storage section 102 (Step Sc4).

After the above process is finished, the controller 1 applies a look-up table reflecting the result of both the manual darkness adjustment and the user calibration to the image data that are entered thereafter. Thus, fluctuations of the image darkness in the image forming device 100 are corrected.

(2-4) Operation Example 4

The following is an explanation of user calibration with a procedure that is different from that of the above-described Operation Example 3.

Figure 11:
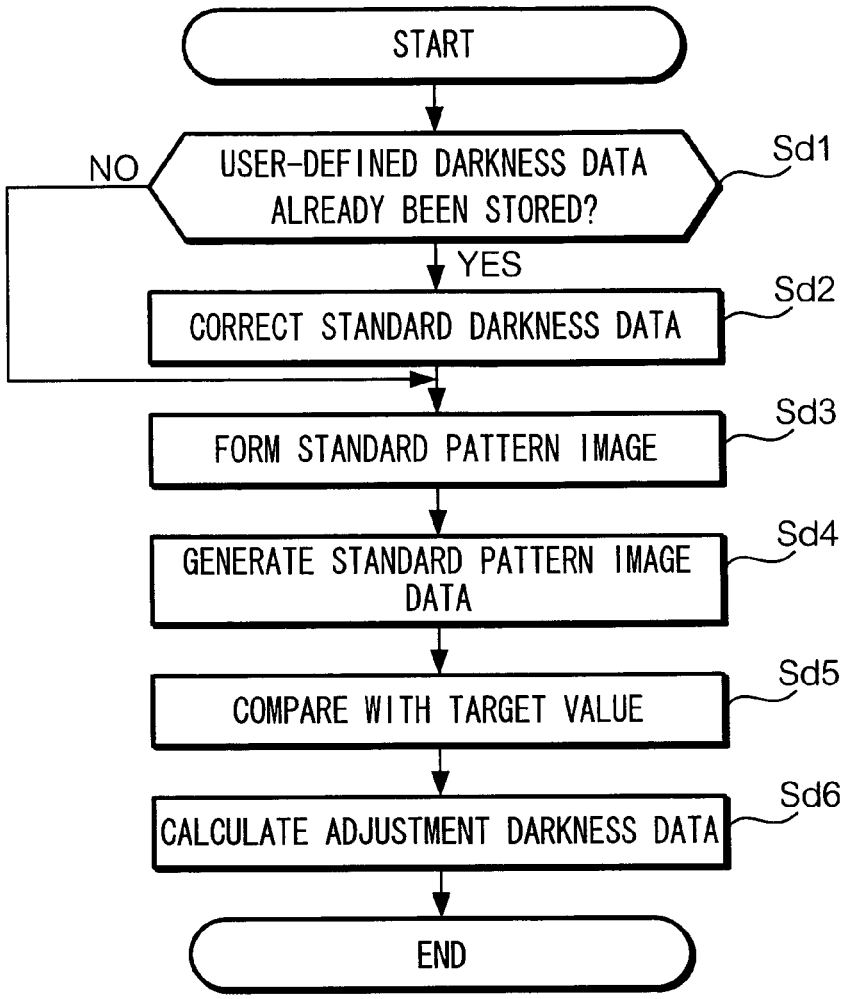
FIG. 11 is a flowchart illustrating an example of a second operation of user calibration according to this embodiment.
Figure 12:
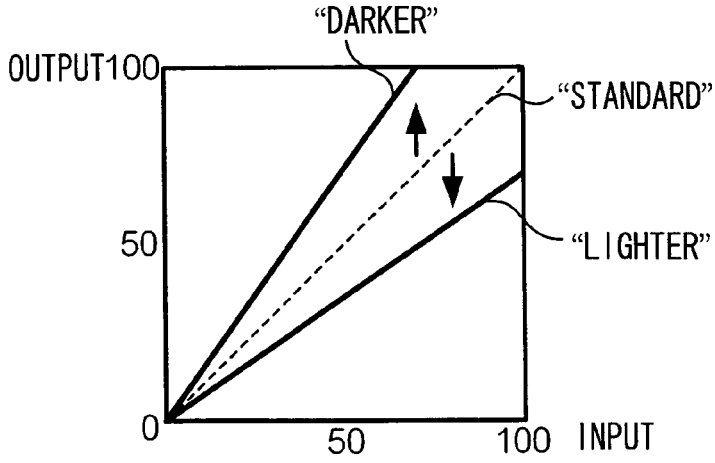
FIG. 12 is a diagram showing an example of correction with a look-up table.

FIG. 11 is a flowchart of this second operation example of user calibration according to the present embodiment. Explaining this operation example in the order shown in the figure, first, the controller 1 of the image forming device 100 judges whether a manual darkness adjustment has been carried out prior to this user calibration, by looking up the storage region of the storage section 102 in which the user-defined darkness data $D_{usr}$ are stored (Step Sd1). Then, if it recognizes that user-defined darkness data $D_{usr}$ are stored (Step Sd1: YES), the controller 1 judges that a manual darkness adjustment has been carried out prior to this user calibration, corrects the standard darkness data $D_{std}$ stored in the storage section 102 in accordance with the value of the user-defined darkness data $D_{usr}$, and performs processing that causes the target value of the standard image to reflect the content that has changed due to the manual darkness adjustment by the user (Step Sd2). Also here, the degree to which the target value of the standard image is caused to reflect the content that has changed due to the manual darkness adjustment by the user can be set appropriately. It should be noted that if no user-defined darkness data $D_{usr}$ are stored (Step Sd1: NO), then the controller 1 judges that no manual darkness adjustment has been carried out prior to the execution of the user calibration, and the above-described processing of Step Sd2 is skipped.

After the above process is finished, the controller 1 causes the image forming section 4 to form a standard pattern image, and outputs this standard pattern image (Step Sd3). The standard pattern image is the same as in the above-described Operation Example 3.

After the standard pattern image has been output, the user sets it into the automatic document feeder 201 of the image reading section 2, causes the standard pattern image on the paper to be read in, and causes the image reading section 2 to generate standard pattern image data resulting from the reading in of the standard pattern image (Step Sd4). Then, the controller 1 compares the standard pattern image data with the standard image data $G_{std}$ serving as the target values (Step Sd5), calculates adjustment darkness data $D_{adj}$ corresponding to the respective differences, and stores the adjustment darkness data $D_{adj}$ in the storage section 102 (Step Sd6).

After the above process is finished, the controller 1 applies the look-up table reflecting the result of both the manual darkness adjustment and the user calibration to any image data entered thereafter. Thus, fluctuations of the image darkness in the image forming device 100 are corrected.

(3) Modified Examples

It should be noted that the present invention is not limited to the above-described embodiments, and various modifications are possible. The following is an explanation of examples of such modifications.

In the foregoing embodiments, the automatic darkness control measured the toner image on the intermediate transfer belt 406 with the toner image darkness sensor 414 and performed the adjustment based on the darkness of this toner image, but there is no limitation to such embodiments. For example, for the automatic darkness control, it is also possible to measure the surface potentials of the electrostatic latent images formed on the photosensitive members 401Y, 401M, 401C and 401K using the potential sensors 412Y, 412M, 412C and 412K, and to perform the adjustment based on the potentials of electrostatic latent images, or to measure the toner densities within the developing devices 404Y, 404M, 404C and 404K with the toner darkness sensors 413Y, 413M, 413C and 413K and to perform the adjustment based on these toner densities.

Furthermore, in the above-described embodiment, the user calibration was performed by outputting a standard pattern image and performing an adjustment based on standard pattern image data resulting from reading in this standard pattern image, but there is no limitation to this. As in the automatic darkness control, and in the user calibration, it is possible to measure the toner image darkness on the intermediate transfer belt 406, the surface potential of the electrostatic latent images on the photosensitive members 401Y, 401M, 401C and 401K, or the toner darkness within the developing devices 404Y, 404M, 404C and 404K, for example.

Furthermore, in the above-described embodiments, the automatic darkness control and the user calibration were realized by a calculation applying look-up tables to the image data. However, as mentioned above, the parameters for adjusting the image formation conditions are not limited to look-up tables, and may also be the charge potential or the amount of exposure light, for example. That is to say, the section performing the automatic darkness control and the user calibration are not limited to the above-described image processing section 103, but may also have a configuration that can change the above-mentioned parameters.

It should be noted that in the above-described Operation Example 1, it was explained that when forming the standard toner patches, the content changed due to the manual darkness adjustment input by the user is not reflected, but it is also possible to provide a switch for switching whether the content changed due to the manual darkness adjustment is reflected during the standard toner patch formation, for example with two operation modes such as a "reflection mode" and a "non-reflection mode", and to persuade the user to select whether to reflect the changed content. Similarly, in the Operation Example 3, it is also possible to provide a switch for switching whether the content changed due to the manual darkness adjustment is reflected during the standard toner patch formation.

Furthermore, for the sake of explanation, the Operation Examples 1 to 4 have been explained as independent embodiments, but needless to say, they can also be combined and carried out simultaneously.

As explained above, according to one embodiment of the present invention, an image forming device is provided that includes an image forming section that forms an image in accordance with predetermined image formation conditions; a storage section that stores a target darkness of a standard image; a measurement section that measures a physical quantity for specifying the darkness of an image formed by the image forming section; a user calibration section that causes the image forming section to form the standard image in response to an instruction input by a user, causes the measurement section to measure the physical quantity when that standard image is formed, and if there is a discrepancy between the darkness of the standard image specified from the physical quantity measured by the measurement section and the target darkness stored in the storage section, adjusts the image formation conditions such that this discrepancy is eliminated; a manual darkness adjustment section that changes the image formation conditions to content that is specified by the user; and a control section that, when the user calibration section causes the image forming section to form the standard image, causes the image forming section to follow image formation conditions that do not reflect the content changed by the manual darkness adjustment section.

In an embodiment, this image forming device further includes a mode switching section that switches between a first operating mode and a second operating mode; wherein in the first operating mode, when the user calibration section causes the image forming section to form the standard image, the control section causes the image forming section to follow image formation conditions reflecting the content changed by the manual darkness adjustment section; and in the second operating mode, when the user calibration section causes the image forming section to form the standard image, the control section causes the image forming section to follow image formation conditions not reflecting the content changed by the manual darkness adjustment section.

In another embodiment according to the present invention, an image forming device is provided that includes an image forming section that forms an image in accordance with predetermined image formation conditions; a storage section that stores a target darkness of a standard image; a measurement section that measures a physical quantity for specifying the darkness of an image formed by the image forming section; a user calibration section that causes the image forming section to form the standard image in response to an instruction input by a user, causes the measurement section to measure the physical quantity when that standard image is formed, and if there is a discrepancy between the darkness of the standard image specified from the physical quantity measured by the measurement section and the target darkness stored in the storage section, adjusts the image formation conditions such that this discrepancy is eliminated; a manual darkness adjustment section that changes the image formation conditions to content that is specified by the user; and a control section that reflects the content of the image formation conditions changed by the manual darkness adjustment section in the target darkness that is stored in the storage section.

With such an image forming device, the image quality preferred by the user is not lost every time when a user calibration is performed, and the user does not need to perform the manual darkness adjustment repeatedly. Thus, it becomes possible to carry out both manual darkness adjustment and user calibration without compromising user-friendliness.

Alternatively, according to another embodiment of the present invention, an image forming device is provided that includes an image forming section that forms an image in accordance with predetermined image formation conditions; a storage section that stores a target darkness of a standard image; a measurement section that measures a physical quantity for specifying the darkness of an image formed by the image forming section; an automatic darkness adjustment section that, at a predetermined timing, causes the image forming section to form a standard image based on the target darkness stored in the storage section, causes the measurement section to measure the physical quantity when that standard image is formed, and if there is a discrepancy between the darkness of the standard image specified from the physical quantity measured by the measurement section and the target darkness stored in the storage section, adjusts the image formation conditions such that this discrepancy is eliminated; a manual darkness adjustment section that changes the image formation conditions to content specified by a user; a control section that, when the automatic darkness adjustment section causes the image forming section to form the standard image, causes the image forming section to follow image formation conditions that do not reflect the content changed by the manual darkness adjustment section.

In an embodiment, this image forming device, further includes a mode switching section that switches between a first operating mode and a second operating mode; wherein in the first operating mode, when the automatic darkness adjustment section causes the image forming section to form the standard image, the control section causes the image forming section to follow image formation conditions reflecting the content changed by the manual darkness adjustment section; and in the second operating mode, when the automatic darkness adjustment section causes the image forming section to form the standard image, the control section causes the image forming section to follow image formation conditions not reflecting the content changed by the manual darkness adjustment section.

In yet another embodiment according to the present invention, an image forming device is provided that includes an image forming section that forms an image in accordance with predetermined image formation conditions; a storage section that stores a target darkness of a standard image; a measurement section that measures a physical quantity for specifying the darkness of an image formed by the image forming section; an automatic darkness adjustment section that, at a predetermined timing, causes the image forming section to form a standard image based on the target darkness stored in the storage section, causes the measurement section to measure the physical quantity when that standard image is formed, and if there is a discrepancy between the darkness of the standard image specified from the physical quantity measured by the measurement section and the target darkness stored in the storage section, adjusts the image formation conditions such that this discrepancy is eliminated; a manual darkness adjustment section that changes the image formation conditions to content that is specified by the user; and a control section that reflects the content of the image formation conditions changed by the manual darkness adjustment section in the target darkness that is stored in the storage section.

With such an image forming device, the image quality preferred by the user is not lost every time that a user calibration is performed, and the user does not need to perform the manual darkness adjustment repeatedly. Thus, it becomes possible to carry out both manual darkness adjustment and user calibration without compromising user-friendliness.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. An image forming device comprising:

an image forming section that forms an image in accordance with predetermined conditions;

a storage section that stores a target darkness of a standard image;

a measurement section that measures a physical quantity for specifying the darkness of the image formed by the image forming section;

a user calibration section that causes the image forming section to form the standard image in response to an instruction input by a user, causes the measurement section to measure the physical quantity when the standard image is formed, and if there is a discrepancy between the darkness of the standard image specified by the measurement of the physical quantity and the target darkness stored in the storage section, adjusts the image formation conditions to eliminate the discrepancy;

a manual darkness adjustment section that changes the image formation conditions to content specified by the user and is reflected in forming images other than the standard image; and a control section that has a first operating mode in which, during an operation by the user, when the user calibration section causes the image forming section to form the standard image, causes the image forming section to follow image formation conditions that do not reflect the content changed by the manual darkness adjustment section, wherein the standard image is used for adjusting forming conditions of the image forming apparatus, wherein the manual darkness adjustment section is not reflected in results with respect to generation of the standard image, even if the manual darkness adjustment section is initiated before the user calibration section, and the manual darkness adjustment section is performed before the user calibration section and is reflected in the results with respect to generation of the image forming conditions.

2. The image forming device according to claim 1, further comprising a mode switching section that switches between the first operating mode and a second operating mode, wherein, in the second operating mode, during an operation by the user, the control section causes the image forming section to follow image formation conditions reflecting the content changed by the manual darkness adjustment section when the user calibration section causes the image forming section to form the standard image.

3. The image forming device according to claim 2, wherein the content of the image formation conditions changed by the manual darkness adjustment section is stored in the storage section.

4. The image forming device according to claim 1, wherein the content of the image formation conditions changed by the manual darkness adjustment section is stored in the storage section.

5. An image forming device comprising:

an image forming section that forms an image in accordance with predetermined conditions;

a storage section that stores a target darkness of a standard image;

a measurement section that measures a physical quantity for specifying the darkness of the image formed by the image forming section;

an automatic darkness adjustment section that, at a predetermined timing, causes the image forming section to form a standard image based on the target darkness stored in the storage section, causes the measurement section to measure the physical quantity when that standard image is formed, and if there is a discrepancy between the darkness of the standard image specified by the measurement of the physical quantity and the target darkness stored in the storage section, adjusts the image formation conditions such that this discrepancy is eliminated;

a manual darkness adjustment section that changes the image formation conditions to content specified by a user and is reflected in forming images other than the standard image; and a control section that has a first operating mode in which, during an operation by the user, when the automatic darkness adjustment section causes the image forming section to form the standard image, causes the image forming section to follow image formation conditions that do not reflect the content changed by the manual darkness adjustment section, wherein the standard image is used for adjusting forming conditions of the image forming apparatus, wherein the manual darkness adjustment section is not reflected in results with respect to generation of the standard image, even if the manual darkness adjustment section is initiated before the user calibration section, and the manual darkness adjustment section is performed before the user calibration section and is reflected in the results with respect to generation of the image forming conditions.

6. The image forming device according to claim 5, further comprising a mode switching section that switches between the first operating mode and a second operating mode, wherein, in the second operating mode, during an operation by the user the control section causes the image forming section to follow image formation conditions reflecting the content changed by the manual darkness adjustment section when the automatic darkness adjustment section causes the image forming section to form the standard image.

7. The image forming device according to claim 6, wherein the content of the image formation conditions changed by the manual darkness adjustment section is stored in the storage section.

8. The image forming device according to claim 5, wherein the content of the image formation conditions changed by the manual darkness adjustment section is stored in the storage section.

* * * * *